US009124041B2

(12) United States Patent
Ebisawa

(10) Patent No.: US 9,124,041 B2
(45) Date of Patent: Sep. 1, 2015

(54) CONNECTOR AND HOUSING STRUCTURE

(75) Inventor: Takeshi Ebisawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 55 days.

(21) Appl. No.: 14/129,127

(22) PCT Filed: Jul. 10, 2012

(86) PCT No.: PCT/JP2012/067541

§ 371 (c)(1),
(2), (4) Date: Dec. 24, 2013

(87) PCT Pub. No.: WO2013/011866

PCT Pub. Date: Jan. 24, 2013

(65) Prior Publication Data

US 2014/0148050 A1 May 29, 2014

(30) Foreign Application Priority Data

Jul. 19, 2011 (JP) ..... 2011-158002

(51) Int. Cl.

| | |
|---|---|
| ***H01R 13/60*** | (2006.01) |
| ***H01R 13/73*** | (2006.01) |
| ***H01R 24/66*** | (2011.01) |
| *H01R 13/74* | (2006.01) |
| *H01R 107/00* | (2006.01) |

(52) U.S. Cl.

CPC ..... *H01R 13/73* (2013.01); *H01R 24/66* (2013.01); *H01R 13/74* (2013.01); *H01R 2107/00* (2013.01)

(58) Field of Classification Search

CPC ..... H01R 13/73; H01R 24/66; H01R 13/74; H01R 2107/00

USPC ..... 439/540.1, 540.5

See application file for complete search history.

(56) References Cited

U.S. PATENT DOCUMENTS

| | | | | |
|---|---|---|---|---|
| 8,888,538 | B2 * | 11/2014 | Regnier | 439/676 |
| 8,894,438 | B2 * | 11/2014 | Schmitt et al. | 439/540.1 |
| 8,939,798 | B2 * | 1/2015 | Oberski | 439/676 |
| 2011/0021058 | A1 | 1/2011 | Todo et al. | |

FOREIGN PATENT DOCUMENTS

| | | | |
|---|---|---|---|
| CN | 101964483 | A | 2/2011 |
| JP | S59-49377 | U | 4/1984 |
| JP | 2008-276991 | A | 11/2008 |
| JP | 2009-252699 | A | 10/2009 |

OTHER PUBLICATIONS

International Search Report of PCT/JP2012/067541, mailed Sep. 25, 2012.

Chinese Office Action with Chinese Search Report in CN 2012800349030, dated Jun. 3, 2015, with an English translation of the relevant part of the Chinese Search Report.

* cited by examiner

*Primary Examiner* — Khiem Nguyen

(74) *Attorney, Agent, or Firm* — Collard & Roe, P.C.

(57) ABSTRACT

A connector includes a housing adapted to be fixed to an attaching object, and contacts. The housing has an attaching base portion, a fitting portion disposed more on the front side than the attaching base portion, through-holes formed through a bottom portion of the fitting portion, and layout spaces each communicating with the through-hole and each open to the outside on the side surface side of the housing. Each contact integrally has a first portion and a second portion continuous with the first portion. The through-hole and the layout space have sizes that can allow the contact to be disposed at a predetermined position in the housing by inserting the contact into the housing through the layout space from the side surface of the housing.

16 Claims, 11 Drawing Sheets

CONNECTOR AND HOUSING STRUCTURE

CROSS REFERENCE TO RELATED APPLICATIONS

This application is the National Stage of PCT/JP2012/067541filed on Jul. 10, 2012, which claims priority under 35 U.S.C. §119 of Japanese Application No. 2011- 158002 filed on Jul. 19, 2011, the disclosures of which are incorporated by reference. The international application under PCT article 21(2) was not published in English.

TECHNICAL FIELD

This invention relates to a connector and a housing structure.

BACKGROUND ART

Conventionally, as shown in FIG. 10, there is known a socket-side connector 110 which is fixed to a protective housing 150 and fitted to a plug-side connector 160 fixed to an object 170 which is housed in the protective housing 150 (see, e.g. Patent Document 1).

As shown in FIG. 11, this conventional socket-side connector 110 comprises a housing 120, socket-type electrical contacts 130 each held by the housing 120, and screw-type holding members 180 each fixed to the housing 120 to prevent coming off of the socket-type electrical contact 130.

As shown in FIG. 11, the socket-type electrical contact 130 is inserted into the housing 120 from the back side of the housing 120 opposite to its front side where a socket portion 133 of the socket-type electrical contact 130 is disposed, and is fixed to the housing 120 by engagement between a base portion 134 of the socket-type electrical contact 130 and a stepped portion 126 of the housing 120 and fixation of the holding member 180 to the housing 120.

PRIOR ART DOCUMENT

Patent Document

Patent Document 1: JP-A-2008-276991

SUMMARY OF THE INVENTION

Problem to be Solved by the Invention

Herein, generally, in the case of the connector like the socket-side connector 110, in terms of inserting the connection object (plug-side connector 160) into the socket-side connector 110, a workspace is necessarily ensured on the socket portion 133 side (on the front side of the housing 120) while there is a case where it is difficult to ensure a workspace on the side opposite to the socket portion 133 side (on the back side of the housing 120).

Then, in the case where the structure is employed in which the socket-type electrical contact 130 is mounted from the back side of the housing 120 like the socket-side connector 110, when the socket-type electrical contact 130 is damaged or the like, it is difficult to replace only the socket-type electrical contact 130 from the housing 120 in the state where the socket-side connector 110 is attached to the attaching object (protective housing 150) and, depending on the structure of the protective housing 150 or the like, there has been a problem that it is necessary to once detach the socket-side connector 110 itself from the attaching object (protective housing 150) and then to replace the socket-type electrical contact 130.

Therefore, this invention aims to solve the conventional problems, that is, it is an object of this invention to provide a connector and a housing structure that can make it possible to easily achieve a replacement operation of a contact without detaching the connector from an attaching object and to realize space saving of a device.

Means for Solving the Problem

A connector according to this invention comprises a housing adapted to be fixed to an attaching object and a contact held by the housing, wherein the housing has an attaching base portion adapted to be fixed to the attaching object, a fitting portion disposed more on a front side than the attaching base portion and having a receiving frame portion and a bottom portion defining a receiving space for receiving a connection object, a through-hole formed through the bottom portion of the fitting portion, and a layout space formed toward a side surface side of the housing from an end portion, on a back side, of the through-hole, communicating with the through-hole, and open to the outside on the side surface side of the housing, wherein the contact integrally has a first portion partially disposed in the through-hole and partially disposed in the receiving space and a second portion continuous with the first portion and at least partially disposed in the layout space, and wherein the through-hole and the layout space have sizes that can allow the contact to be disposed at a predetermined position in the housing by inserting the contact, with the first portion at the head, into the housing through the layout space from the side surface of the housing, thereby solves the above-mentioned problems.

Movement of the first portion of the contact in a direction perpendicular to an insertion direction of inserting the connection object may be restricted by an edge portion of the through-hole.

The first portion and the second portion of the contact each may be formed in a flat plate shape.

The second portion of the contact may have a portion located outside the receiving frame portion when seen in an insertion direction of inserting the connection object.

The second portion of the contact may have an upper and a Lower portion located outside the receiving frame portion, the upper and lower portions each having a bolt hole formed therethrough along the insertion direction.

The attaching base portion may have a bolt hole formed therethrough along an insertion direction of inserting the connection object, wherein the bolt hole of the attaching base portion is formed outside the receiving frame portion when seen in the insertion direction.

The attaching base portion may have bolt holes formed therethrough along the insertion direction, wherein the bolt holes of the attaching base portion are formed outside the receiving frame portion when seen in the insertion direction, and wherein the bolt holes of the second portion of the contact and the bolt holes of the attaching base portion at least partially overlap each other in the insertion direction.

The connector may further comprise a spacer member pressing the first portion of the contact against an edge portion of the through-hole, wherein the bottom portion of the fitting portion is formed with a spacer holding portion detachably holding the spacer member from the front side.

The receiving frame portion of the fitting portion may have an inner wall formed with a guide portion that guides insertion of the connection object.

The fitting portion may be formed with a movement restricting portion that restricts movement of the second portion of the contact in an insertion direction of inserting the connection object jointly with part, facing the movement restricting portion in the insertion direction, of the attaching base portion.

The attaching base portion may be formed with a guide portion that guides the second portion of the contact when the contact is attached to and detached from the housing.

The connector may further comprise a signal contact.

A connector-attached housing structure according to this invention comprises the connector and a housing structure to which the connector is attached, thereby cloves the above-mentioned problems.

The connector may comprises a plurality of connectors which are attached, in a lattice shape, to an attaching panel of the housing structure, wherein the housing structure further comprises connecting members each connecting between the contacts of two of the connectors.

The plurality of connectors attached to the attaching panel may be connected in series by the connecting members.

The connector may further comprise a signal contact connected to an electric wire, wherein the plurality of connectors are connected in series by the electric wires.

Effect of the Invention

According to this invention, since a connector is configured such that a contact can be inserted and removed from the side surface side of a housing, an insertion/removal operation of the contact can be carried out on the front side, where a fitting portion to a connection object is disposed, of the housing. Therefore, a workspace is easy to ensure so that a replacement operation of the contact can be easily achieved in the state where the connector is attached to an attaching object, and further, it is not necessary to ensure a workspace on the back side of the attaching object so that space saving of a device can be realized.

MODE FOR CARRYING OUT THE INVENTION

Hereinbelow, a connector as one embodiment of this invention will be described with reference to the drawings.

In the following description, a direction in which a battery-side connector (connection object) is inserted into the connector is defined as a first direction (insertion direction) X, a contact insertion/removal direction with respect to a housing (and a parallel arrangement direction of a pair of contacts with respect to the housing) is defined as a second direction Y, and a direction perpendicular to the first direction X and the second direction Y is defined as a third direction Z. In the following embodiment, a description will be given assuming that the second direction Y is perpendicular to the first direction X. However, it may be configured such that the second direction Y is not perpendicular to the first direction X. Further, in the following embodiment, the second direction Y coincides with the horizontal direction and the third direction Z coincides with the vertical direction in the state where the connector is attached to a housing rack. However, the carrying-out manner is not limited thereto.

Embodiment

Figure 1:
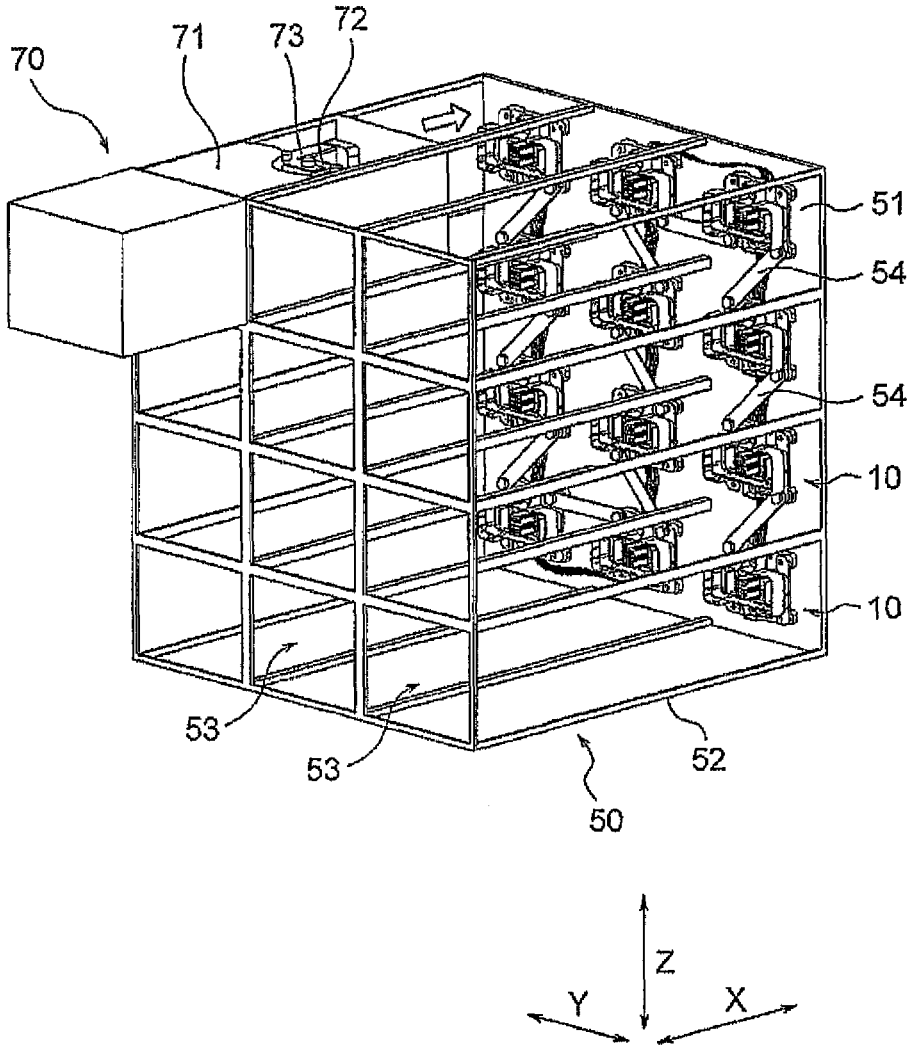
FIG. 1 is a diagram showing the manner of using connectors according to one embodiment of this invention.
Figure 2:
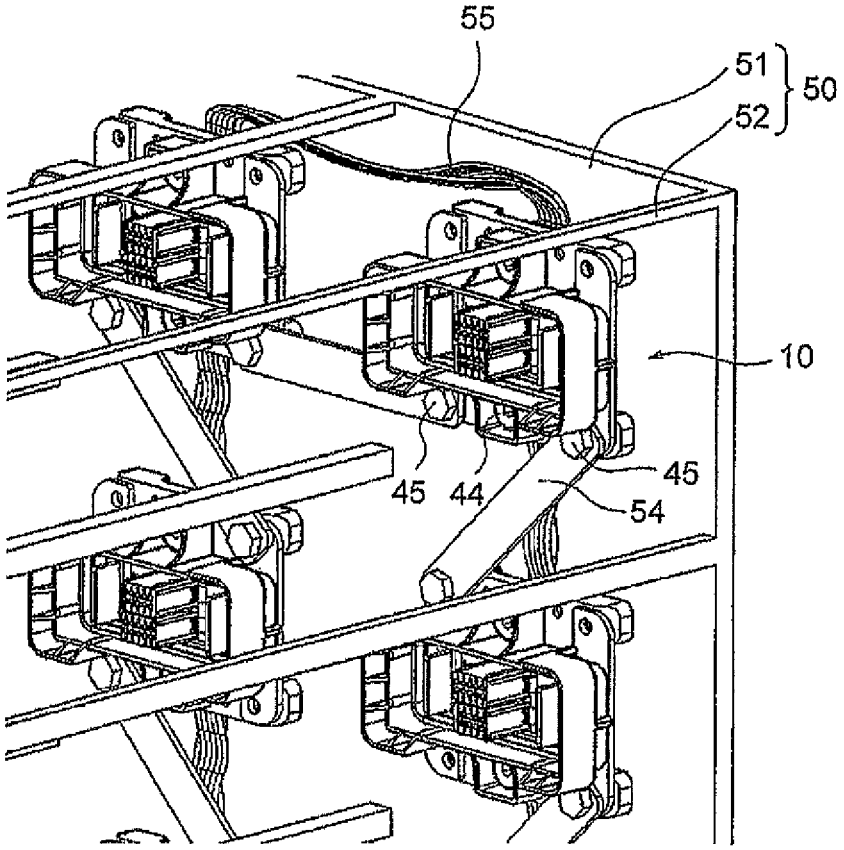
FIG. 2 is a perspective view showing part of FIG. 1 on an enlarged scale.
Figure 2:
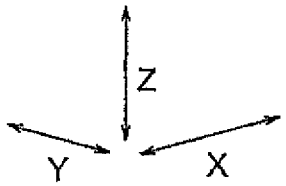
Figure 3:
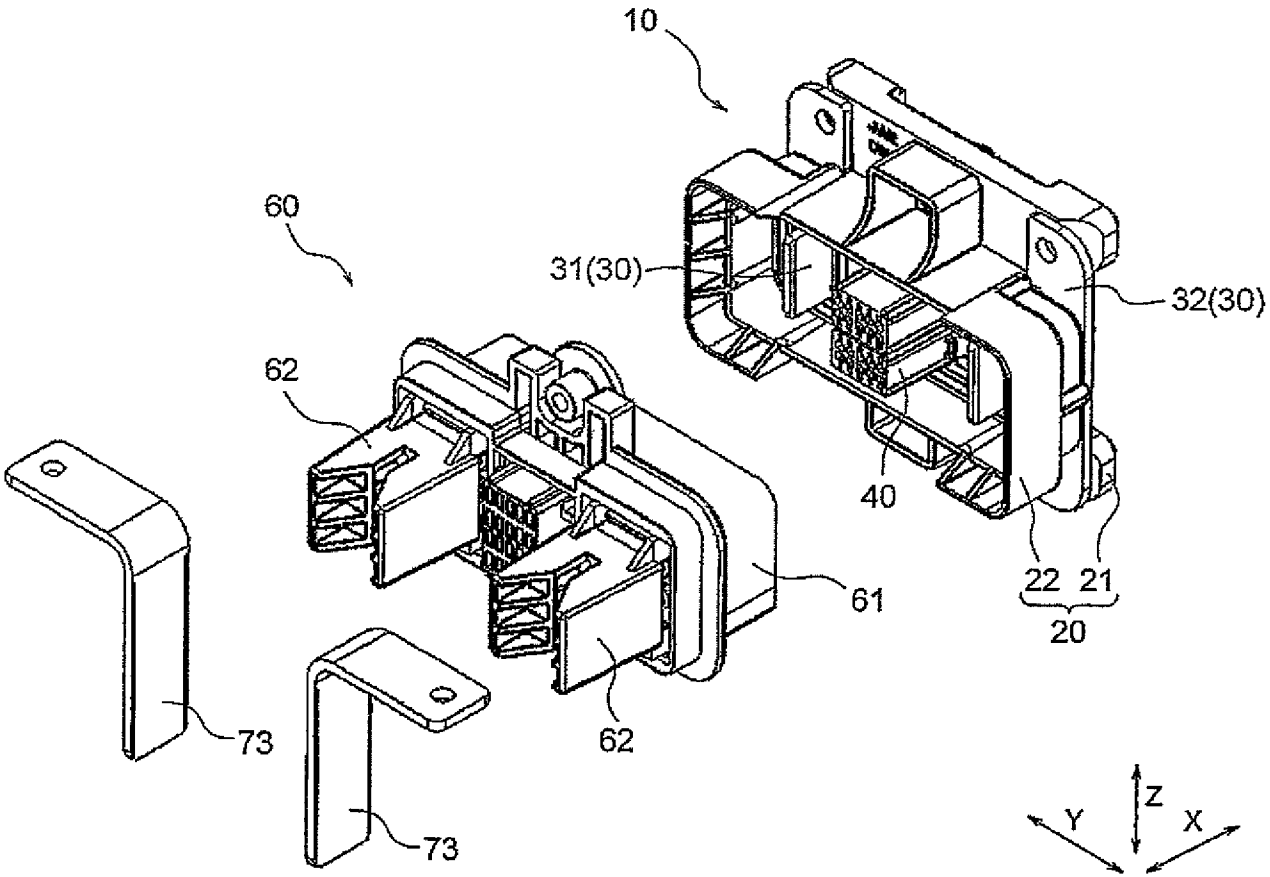
FIG. 3 is a perspective view showing the connector, a battery-side connector, and battery-side bus bars.

Connectors 10 of this embodiment are each a power supply connector. As shown in FIGS. 1 to 3, the connectors 10 are attached to an attaching panel (attaching object) 51 of a housing rack (housing structure) 50 and, when a battery unit 70 is inserted into the housing rack 50, the connector 10 is fitted to a battery-side connector 60 attached to the battery unit 70.

Figure 4:
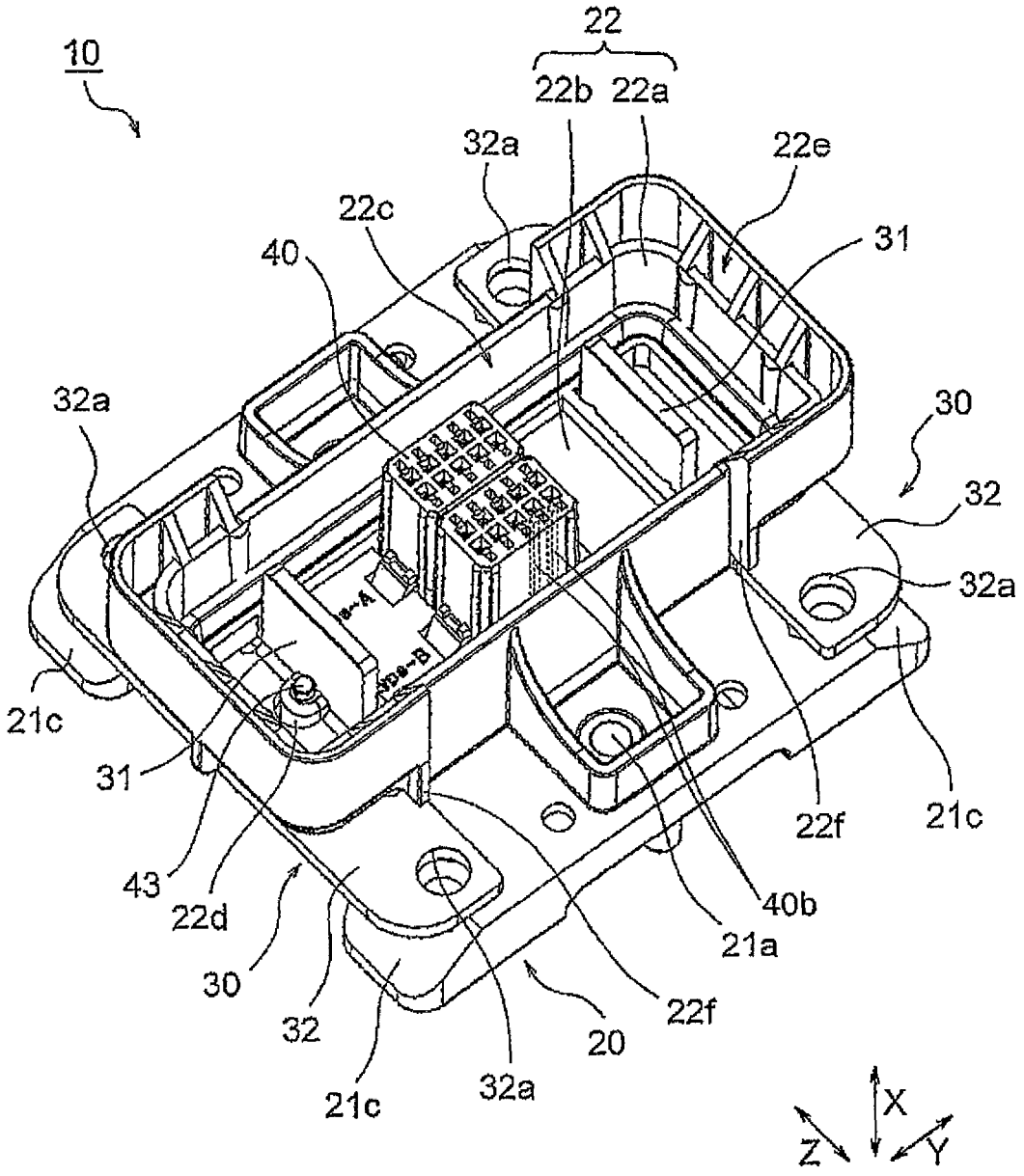
FIG. 4 is a perspective view showing the connector.
Figure 5:
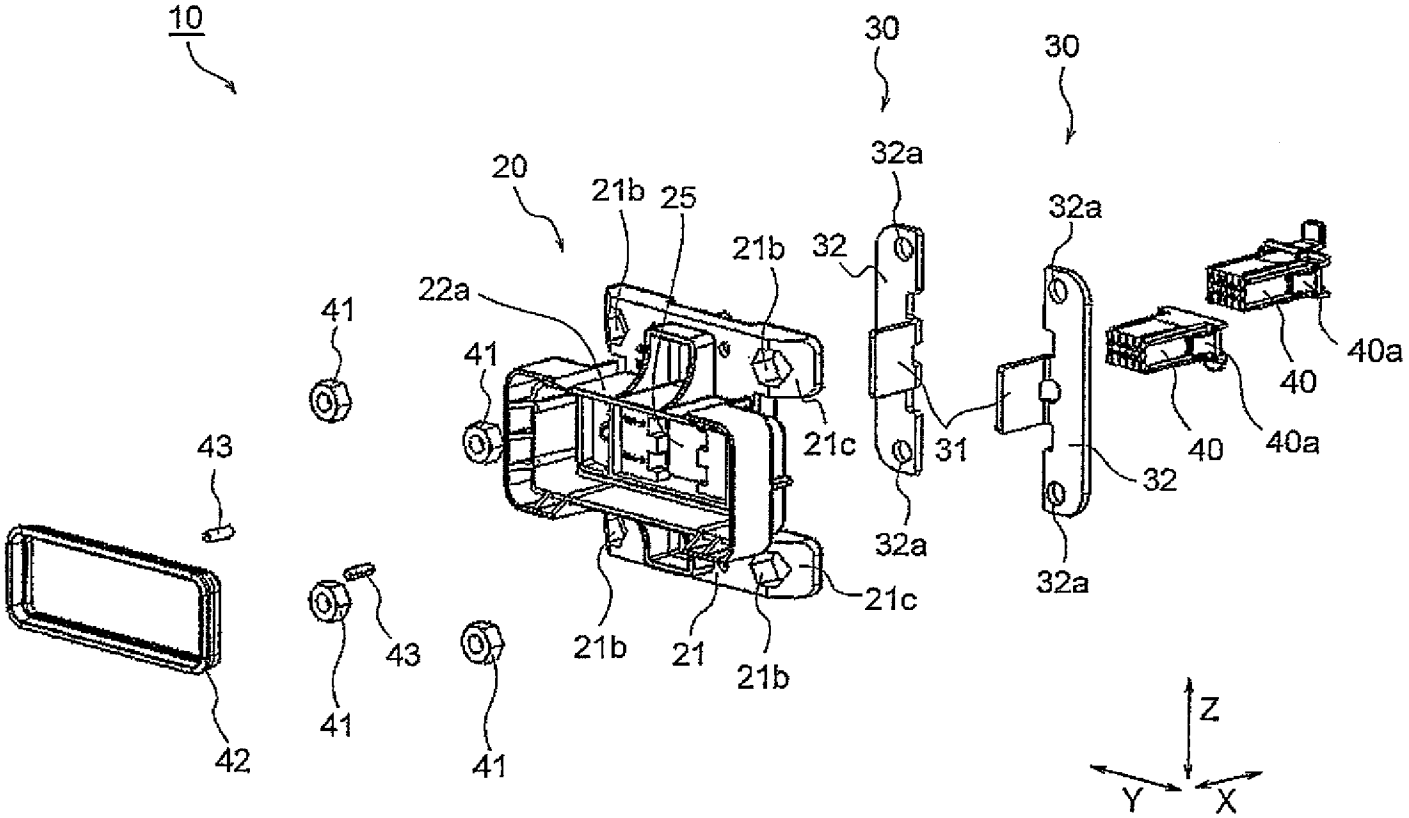
FIG. 5 is an exploded perspective view showing the connector.

As shown in FIGS. 4 and 5, each connector 10 comprises a housing 20 which is fixed on its back side to the attaching panel 51 of the housing rack 50, a pair of contacts 30 which are held by the housing 20, signal housings 40 which are attached to the housing 20 and hold signal contacts 40*b*, nuts 41 which are attached to the housing 20, a gasket 42 which is attached to the housing 20, and spacer members 43 which are attached to the housing 20, and further comprises, as shown in FIG. 2, first bolts 44 for fixing the housing 20 to the attaching panel 51 and second bolts 45 for fixing the housing 20, the contacts 30, and bus bars (connecting members) 54 to the attaching panel 51.

Figure 6:
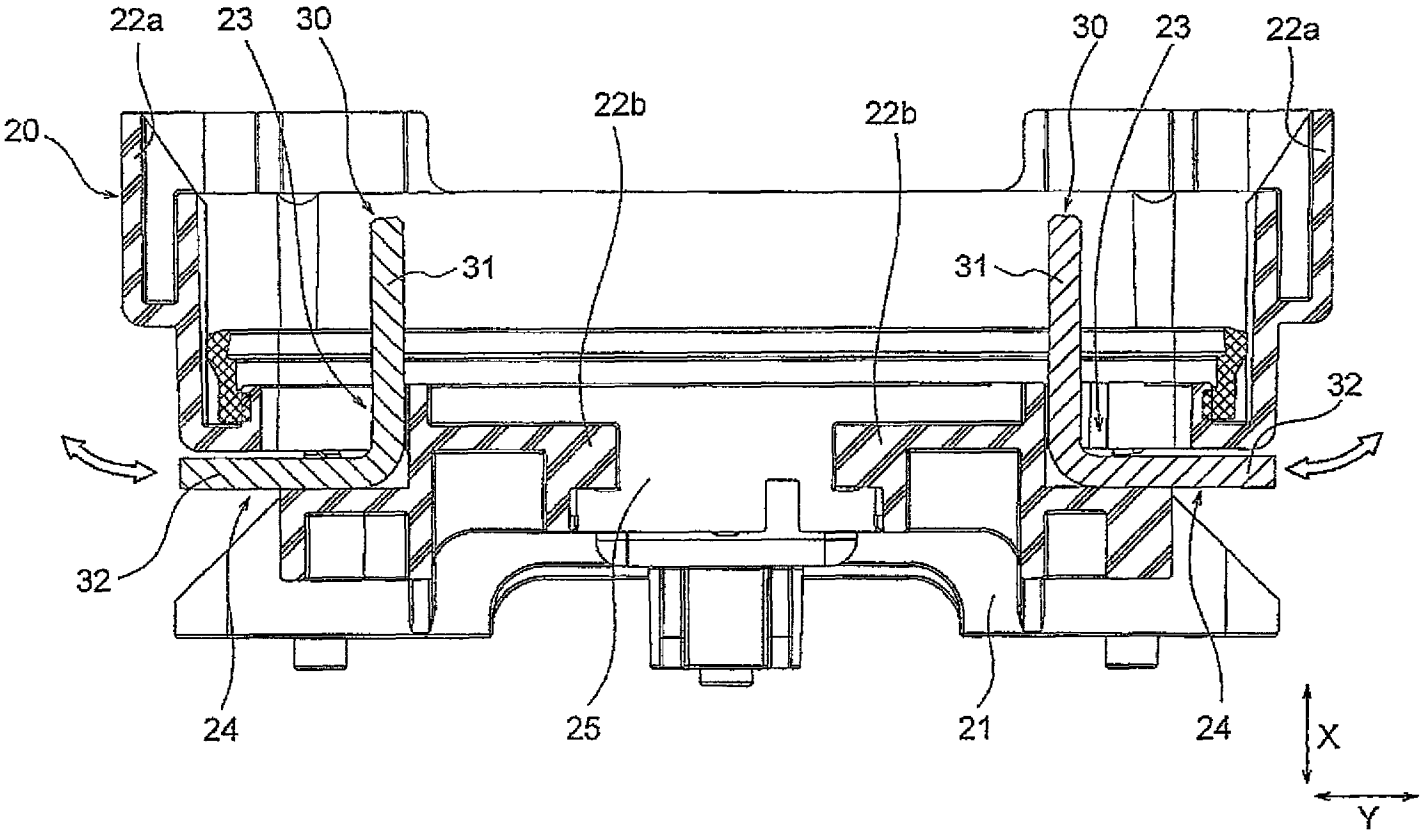
FIG. 6 is an explanatory diagram showing a contact insertion/removal method with the connector and an attaching panel viewed in cross section.

As shown in FIGS. 4 to 6, the housing 20 has an attaching base portion 21 which is fixed to the housing rack 50, a fitting portion 22 which is disposed more on the front side than the attaching base portion 21, and a signal housing holding portion 25 which is penetratingly formed along the first direction X and holds the signal housings 40.

As shown in FIGS. 4 and 5, the attaching base portion 21 has a portion located outside a receiving frame portion 22*a* (fitting portion 22) when seen in the first direction X and this portion has first bolt holes 21*a* for the first bolts 44 to pass through, second bolt holes 21*b* for the second bolts 45 to pass through, and guide portions 21*c* for guiding second portions 32 of the contacts 30 when the contacts 30 are attached to and detached from the housing 20.

As shown in FIG. 4, the fitting portion 22 has the receiving frame portion 22*a* and a bottom portion 22*b*, a receiving space 22*c* which is defined by the receiving frame portion 22*a* and the bottom portion 22*b* and open to the front side of the housing 20 for allowing the battery-side connector 60 to be inserted and received from the front side of the housing 20, spacer holding portions 22*d* formed on the bottom portion 22*b* for holding the spacer members 43, a guide portion 22*e* formed on an inner wall of the receiving frame portion 22*a* for guiding the battery-side connector 60, and movement restricting portions 22*f* each for restricting movement of the second portion 32 of the contact 30 in the first direction X jointly with part, facing the movement restricting portion 22*f* in the first direction X, of the attaching base portion 21.

As shown in FIG. 6, the housing 20 further has through-holes 23 formed through the bottom portion 22*b* of the fitting portion 22 along the first direction X and layout spaces 24 each formed between the attaching base portion 21 and the fitting portion 22, each formed toward the side surface side of the housing 20 from an end portion, on the back side, of the through-hole 23, each communicating with the through-hole 23, and each open to the outside on the side surface side of the housing 20.

The through-hole 23 and the layout space 24 have sizes, positions, and shapes that can allow the contact 30 to be disposed at a predetermined position in the housing 20 by inserting the contact 30, with its first portion 31 at the head, into the housing 20 through the layout space 24 from the side surface of the housing 20.

Figure 7:
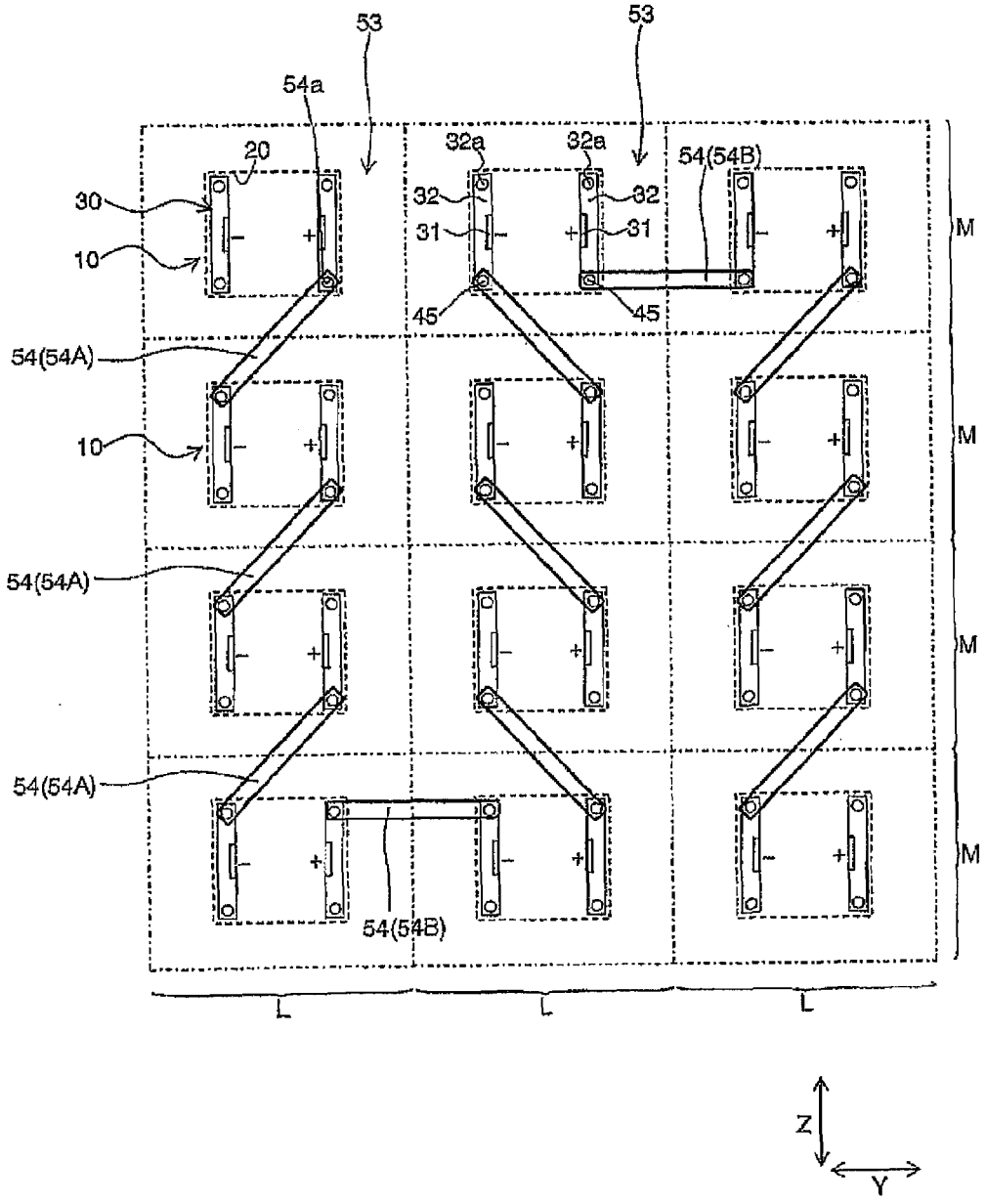
FIG. 7 is an explanatory diagram showing the connector arrangement and the manner of connection between the connectors by bus bars in the embodiment of this invention.

Each contact 30 is a power supply contact and is electrically connected to a battery-side contact (not illustrated) of the battery-side connector 60 when the connector 10 and the battery-side connector 60 are fitted to each other. As shown in FIG. 4, the contacts 30 are arranged in a pair parallel to each other in the second direction Y with respect to the housing 20. As shown in FIGS. 1 and 7, the contacts 30 of the connectors 10 attached to the housing rack 50 are connected to each other by the bus bar 54 as the connecting member so that the connectors 10 are connected in series by the bus bars 54.

The contacts 30 are formed of an inelastic conductive metal (tough pitch copper, copper with a purity of about 99%) and have the same shape. In this embodiment, each contact 30 has a conductivity of 50% or more assuming that the conductivity of pure copper is 100%. Each contact 30 is formed by punching a metal plate into a predetermined shape and then bending a predetermined portion thereof and thus has a shape with no overlapping portion when developed on a plane.

As shown in FIGS. 4 and 5, each contact 30 has the second portion 32 formed in a flat plate shape and the first portion 31 of a flat plate shape standing perpendicular to the second portion 32 at the middle, in a longitudinal direction, of the second portion 32.

As shown in FIGS. 4 and 6, the first portion 31 of the contact 30 extends in the first direction X and, in the state where the contact 30 is mounted to the housing 20, the first portion 31 is partially disposed in the through-hole 23 and partially disposed in the receiving space 22*c*. The first portion 31 located in the receiving space 22*c* serves as a contact portion which is brought into contact with the battery-side contact (not illustrated) of the battery-side connector 60.

As shown in FIGS. 4 and 6, the second portion 32 of the contact 30 is partially disposed in the layout space 24 in the state where the contact 30 is mounted to the housing 20. The second portion 32 has portions located outside the receiving frame portion 22*a* (fitting portion 22) and protruding toward both sides, in the third direction Z, of the receiving frame portion 22*a* when seen in the first direction X and these portions each have a bolt hole 32*a* for the second bolt 45 to pass through. As shown in FIG. 4, the bolt holes 32*a* are respectively formed at both ends, in the third direction Z, of the second portion 32 and, in the state where the contact 30 is mounted to the housing 20, the bolt holes 32*a* are formed at positions overlapping, in the first direction X, the second bolt holes 21*b* formed in the attaching base portion 21. In this embodiment, a portion around this bolt hole 32*a* serves a connecting portion with the bus bar 54.

The signal housings 40 are inserted from the back side of the housing 20 into the signal housing holding portion 25 formed in the housing 20 and are locked to the housing 20 by mounting spring portions 40*a* provided to the signal housings 40. As shown in FIG. 4, the signal housings 40 are partially located in the receiving space 22*c*. Symbol 55 shown in FIG. 2 denotes signal lines (electric wires) connecting between the signal contacts 40*b* of the respective connectors 10.

Each spacer member 43 is formed as a spring pin having a groove on its outer periphery. As shown in FIGS. 4 and 5, each spacer member 43 is detachably mounted to the spacer holding portion 22*d* of the housing 20 from the front side of the housing 20 and presses the first portion 31 of the contact 30 against an edge portion of the through-hole 23 in the second direction Y, thereby preventing backlash between the through-hole 23 and the first portion 31.

As shown in FIG. 2, each first bolt 44 is inserted from the front side of the housing 20 through the first bolt hole 21*a* formed in the housing 20 and a bolt hole (not illustrated) formed in the attaching panel 51, thereby fixing the housing 20 to the attaching panel 51.

As shown in FIG. 2, each second bolt 45 is inserted from the front side of the housing 20 through the second bolt hole 21*b* formed in the housing 20, the bolt hole 32*a* formed in the second portion 32 of the contact 30, a bolt hole 54*a* formed in the bus bar 54, and a bolt hole (not illustrated) formed in the attaching panel 51, thereby fixing the housing 20, the contact 30, and the bus bar 54 to the attaching panel 51.

As shown in FIGS. 1 and 2, the housing rack 50 has the attaching panel 51 to which the connectors 10 are attached, and a frame 52 defining a plurality of battery unit housing portions 53 each for housing the battery unit 70. The battery unit 70 is guided by the frame 52 of the housing rack 50 when it is inserted into the housing rack 50, while, the battery unit 70 is supported by the frame 52 of the housing rack 50 when it is housed in the housing rack 50.

The battery-side connector 60 is attached to a casing 71 of the battery unit 70 and, when the battery unit 70 is inserted into the housing rack 50, the battery-side connector 60 is fitted to the connector 10 attached to the housing rack 50, thereby establishing electrical connection between battery-side bus bars 73 incorporated in the battery unit 70 and connected to batteries (secondary batteries) 72 and the contacts 30. As shown in FIG. 3, the battery-side connector 60 comprises a first battery-side housing 61 which is attached to the casing 71 in the state where it is movable at least in the second direction Y, second battery-side housings 62 each attached to the first battery-side housing 61 so as to be slidable in the second direction Y relative to the first battery-side housing 61, and power supply battery-side contacts (not illustrated) housed in contact housing portions (not illustrated) each formed by the first battery-side housing 61 and the second battery-side housing 62.

Next, a method for replacing the contact 30 will be described hereinbelow.

Herein, in the connector 10 for use in power supply as in this embodiment, it may happen that the contact 30 is damaged due to heat generation or the like caused by flowing a large current and thus should be replaced immediately. In the connector 10 of this embodiment, the contact 30 is replaced by the following steps.

First, in the state where the housing 20 and the attaching panel 51 are fixed together without removing the first bolts 44, the second bolt 45 fixing the housing 20, the contact 30, and the bus bar 54 to the attaching panel 51 is removed from the front side of the housing 20 (first step).

Then, the spacer member 43 is removed from the housing 20 on the front side of the housing 20 (second step). The order of the first and second steps may be reversed to the above.

Herein, in the state after the first and second steps, the movement of the first portion 31 of the contact 30 is restricted in the second direction Y and the third direction Z by the edge portion of the through-hole 23 while the movement of the second portion 32 of the contact 30 is restricted in the first direction X by the attaching base portion 21 and the movement restricting portion 22*f*. Consequently, the contact 30 is loosely held by the housing 20 and thus does not come off the housing 20.

Then, as shown in FIG. 6, the contact 30 is caused to slide outward in the second direction Y relative to the housing 20 so that the first portion 31 of the contact 30 is pulled out of the through-hole 23 and simultaneously the second portion 32 of the contact 30 is pulled out of the layout space 24, thereby removing the contact 30 from the layout space 24 which is open to the outside at the side surface of the housing 20 (third step).

Then, a new contact 30 is inserted, with its first portion 31 at the head, into the housing 20 through the layout space 24 so that the contact 30 is disposed at the predetermined position in the housing 20 (fourth step).

Herein, in the state after the fourth step, the movement of the first portion 31 of the contact 30 is restricted in the second direction Y and the third direction Z by the edge portion of the through-hole 23 while the movement of the second portion 32 of the contact 30 is restricted in the first direction X by the attaching base portion 21 and the movement restricting portion 22*f*. Consequently, the contact 30 is loosely held by the housing 20 and thus does not come off the housing 20.

Then, using the second bolt 45, the housing 20, the contact 30, and the bus bar 54 are fixed to the attaching panel 51 (fifth step).

Finally, the spacer member 43 is mounted to the spacer holding portion 22*d* of the housing 20 (sixth step). The order of the fifth and sixth steps may be reversed to the above.

Figure 8:
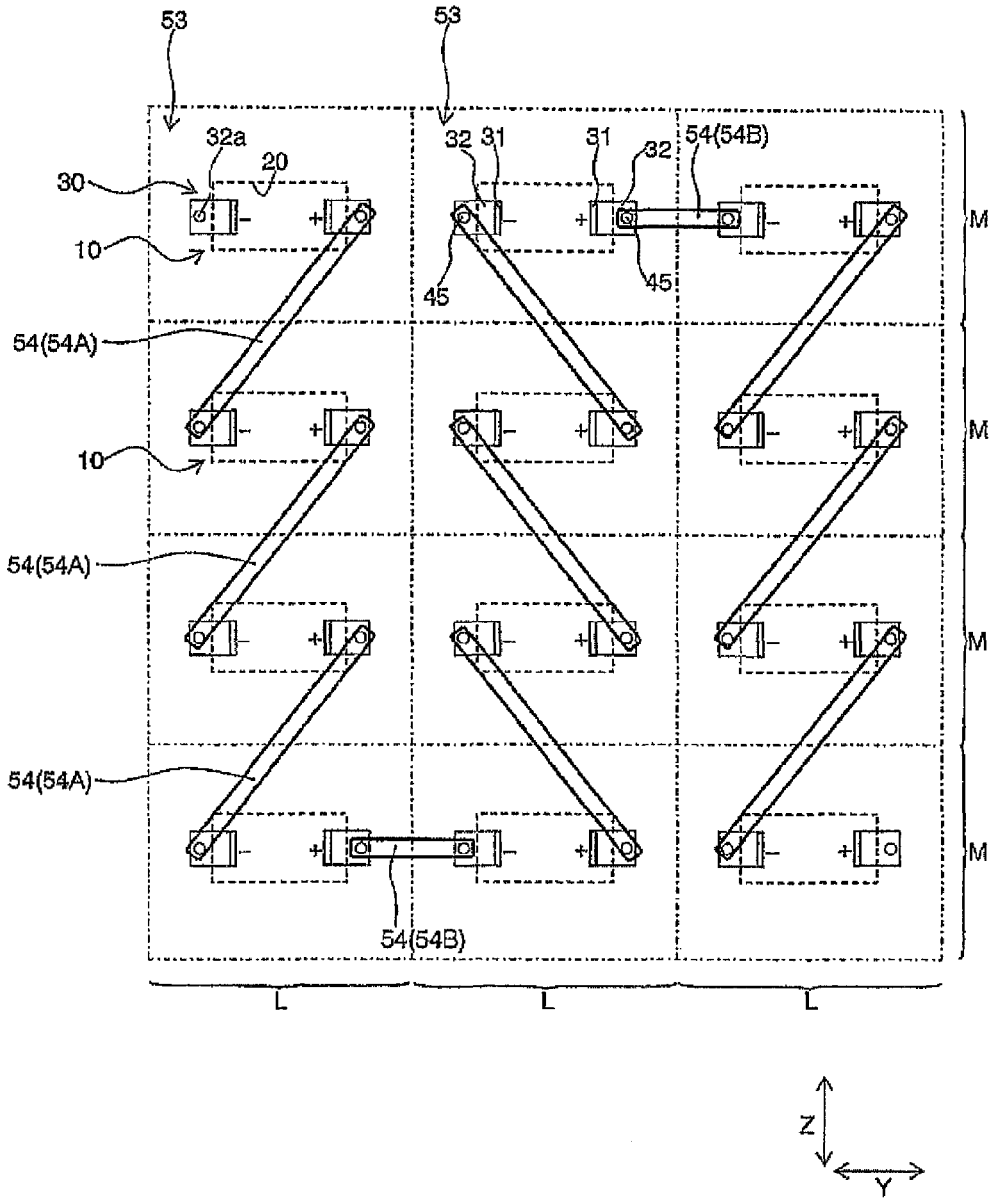
FIG. 8 is an explanatory diagram showing a comparative example of the connector arrangement and the manner of connection between connectors by bus bars.

Next, the manner of arrangement of the connectors 10 with respect to the housing rack 50 and the manner of connection between the connectors 10 by the bus bars 54 in this embodiment will be described hereinbelow with reference to FIG. 7 showing the carrying-out manner of this embodiment and FIG. 8 showing the carrying-out manner of a comparative example.

First, in this embodiment, as shown in FIG. 7, when seen in the first direction X, the battery unit housing portions 53 are arranged in a lattice shape with 3 rows×4 columns (second direction Y ×third direction Z) and, following this, the connectors 10 are attached to the attaching panel 51 in a lattice shape with 3 rows×4 columns (second direction Y ×third direction Z). The specific numbers of rows and columns are not limited to the above.

In this embodiment, in order that combinations of the battery units 70 and the battery unit housing portions 53 may not be restricted, that is, in order to allow any battery unit 70 to be housed in any battery unit housing portion 53, all the battery unit housing portions 53 have the same structure, all the connectors 10 have the same structure, and all the battery units 70 have the same structure.

In this embodiment, as described before, the connectors 10 are connected in series by the bus bars 54.

Therefore, as shown in FIG. 7 (or FIG. 8), when connecting the connectors 10 in series using the bus bars 54, the right-side (or left-side) contacts 30 of the connectors 10 located above and the left-side (or right-side) contacts 30 of the connectors 10 located below are obliquely connected to each other by the bus bar 54 to thereby connect together the connectors 10 aligned in the third direction Z and further the connectors 10 adjacent to each other in the second direction Y are connected together by the bus bar 54 disposed along the second direction Y.

Herein, the dimension M in the third direction Z of each battery unit housing portion 53 and the dimension L in the second direction Y of each battery unit housing portion 53 are determined according to the dimensions in the second direction Y and the third direction Z of the battery unit 70. Therefore, as shown in FIG. 8 of the comparative example, when each contact 30 is provided with a single connecting portion with the bus bar 54 (in this embodiment, the portion around the bolt hole 32*a* formed in the contact 30), it is difficult to adjust the dimensional relationship between the bus bar 54 (54A) for connection between the connectors 10 in the third direction Z and the bus bar 54 (54B) for connection between the connectors 10 in the second direction Y so that the bus bars with two kinds of dimensions are required.

In view of this, in this embodiment, as shown in FIG. 7, each contact 30 is provided with the two connecting portions and these two connecting portions are aligned in the third direction Z, thereby adjusting the required dimension of the bus bar 54 (54A) for connection between the connectors 10 in the third direction Z so that the dimension of the bus bar 54 (54A) for connection between the connectors 10 in the third direction Z and the dimension of the bus bar 54 (54B) for connection between the connectors 10 in the second direction Y are set to be equal to each other.

According to this invention, since the connector 10 is configured such that the contact 30 can be inserted and removed from the side surface side of the housing 20, the insertion/removal operation of the contact 30 can be carried out on the front side, where the fitting portion 22 to the battery-side connector (connection object) 60 is disposed, of the housing 20. Therefore, a workspace is easy to ensure so that the replacement operation of the contact 30 can be easily achieved in the state where the connector 10 is attached to the attaching panel (attaching object) 51, and further, it is not necessary to ensure a workspace on the back side of the attaching panel (attaching object) 51 so that space saving of a device can be realized.

In the foregoing embodiment, the description has been given assuming that the contact is the power supply contact. However, the contact may alternatively be used as a signal contact.

Figure 9:
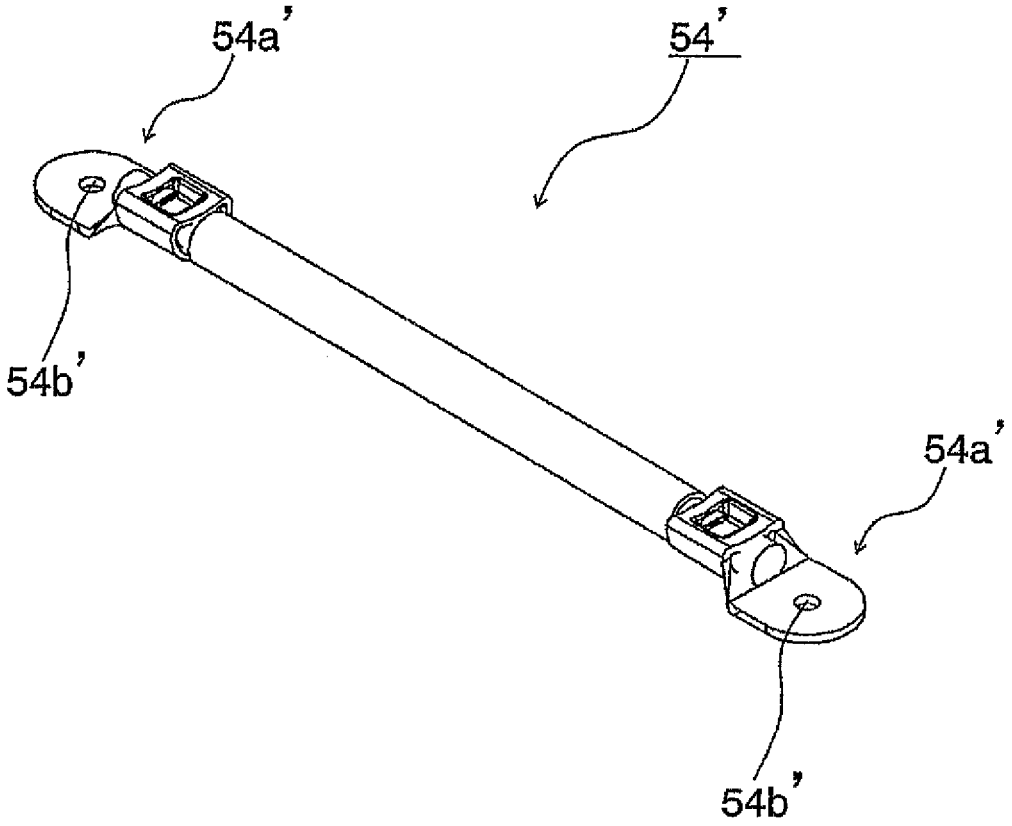
FIG. 9 is a perspective view showing a feeder as a modification of a connecting member.
Figure 10:
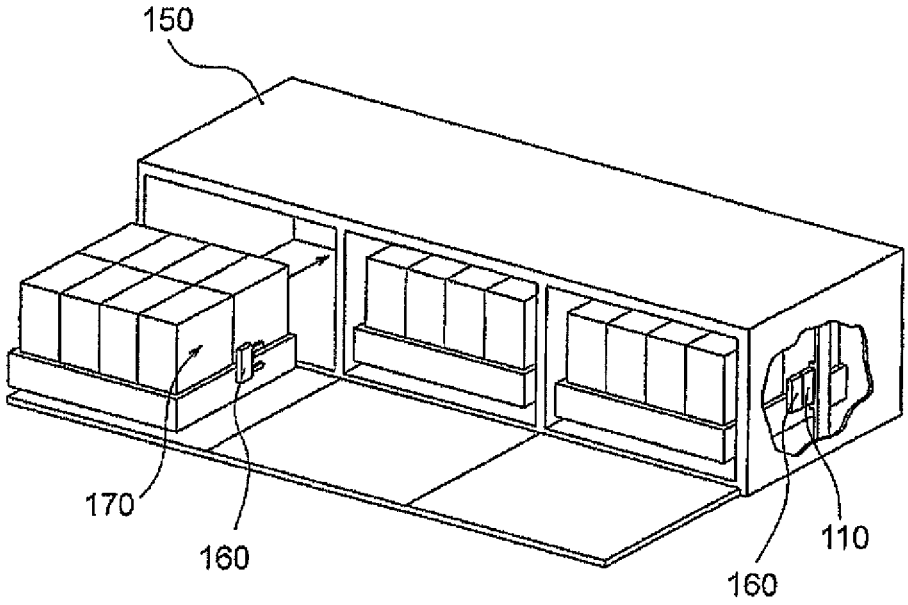
FIG. 10 is a diagram showing the manner of using conventional socket-side connectors.
Figure 11:
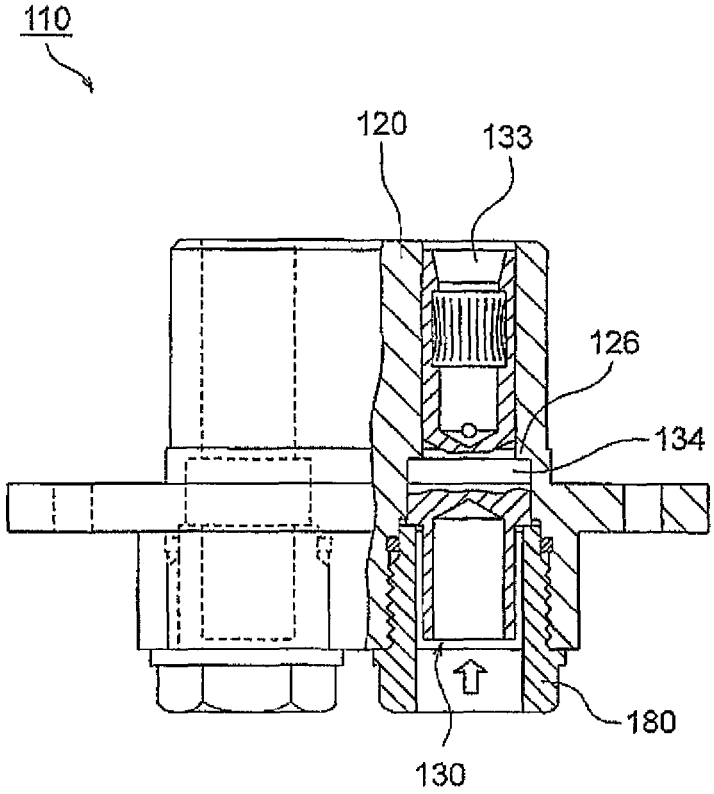
FIG. 11 is a partially cross-sectional view showing the conventional socket-side connector.

In the foregoing embodiment, the description has been given of the carrying-out manner using the bus bar 54 as the connecting member for connection between the connectors 10. However, a specific manner of the connecting member may be any as long as it can connect between the connectors 10. For example, a feeder 54' shown in FIG. 9 may be used instead of each of part or all of the bus bars 54. Terminals 54*a*' each having a hole 54*b*' for the second bolt 45 to pass through are connected to both ends of the feeder 54'.

DESCRIPTION OF SYMBOLS

10 connector
20 housing
21 attaching base portion
21*a* first bolt hole
21*b* second bolt hole
21*c* guide portion
22 fitting portion
22*a* receiving frame portion
22*b* bottom portion
22*c* receiving space
22*d* spacer holding portion
22*e* guide portion
22*f* movement restricting portion
23 through-hole
24 layout space
25 signal housing holding portion
30 contact
31 first portion

32 second portion
32*a* bolt hole
40 signal housing
40*a* mounting spring portion
40*b* signal contact
41 nut
42 gasket
43 spacer member
44 first bolt
45 second bolt
50 housing rack (housing structure)
51 attaching panel (attaching object)
52 frame
53 battery unit housing portion
54 bus bar (connecting member)
54*a* bolt hole
54' feeder
54*a*' terminal
54*b*' hole
55 signal line (electric wire)
60 battery-side connector (connection object)
61 first battery-side housing
62 second battery-side housing
70 battery unit
71 casing
72 battery
73 battery-side bus bar
X first direction (insertion direction)
Y second direction
Z third direction

The invention claimed is:

1. A connector comprising:

a housing adapted to be fixed to an attaching object, and a contact held by the housing, wherein the housing has:

an attaching base portion adapted to be fixed to the attaching object, a fitting portion disposed more on a front side than the attaching base portion and having a receiving frame portion and a bottom portion defining a receiving space for receiving a connection object, a through-hole formed through the bottom portion of the fitting portion, and a layout space formed toward a side surface side of the housing from an end portion, on a back side, of the through-hole, communicating with the through-hole, and open to the outside on the side surface side of the housing, wherein the contact integrally has:

a first portion partially disposed in the through-hole and partially disposed in the receiving space, and a second portion continuous with the first portion and at least partially disposed in the layout space, and wherein the through-hole and the layout space have sizes that can allow the contact to be disposed at a predetermined position in the housing by inserting the contact, with the first portion at the head, into the housing through the layout space from the side surface of the housing.

2. The connector according to claim 1, wherein movement of the first portion of the contact in a direction perpendicular to an insertion direction of inserting the connection object is restricted by an edge portion of the through-hole.

3. The connector according to claim 1, wherein the first portion and the second portion of the contact are each formed in a flat plate shape.

4. The connector according to claim 1, wherein the second portion of the contact has a portion located outside the receiving frame portion when seen in an insertion direction of inserting the connection object.

5. The connector according to claim 4, wherein the second portion of the contact has an upper and a lower portion located outside the receiving frame portion, the upper and lower portions each having a bolt hole formed therethrough along the insertion direction.

6. The connector according to claim 1, wherein the attaching base portion has a bolt hole formed therethrough along an insertion direction of inserting the connection object, and wherein the bolt hole of the attaching base portion is formed outside the receiving frame portion when seen in the insertion direction.

7. The connector according to claim 5, wherein the attaching base portion has bolt holes formed therethrough along the insertion direction, wherein the bolt holes of the attaching base portion are formed outside the receiving frame portion when seen in the insertion direction, and wherein the bolt holes of the second portion of the contact and the bolt holes of the attaching base portion at least partially overlap each other in the insertion direction.

8. The connector according to claim 1, further comprising a spacer member pressing the first portion of the contact against an edge portion of the through-hole, wherein the bottom portion of the fitting portion is formed with a spacer holding portion detachably holding the spacer member from the front side.

9. The connector according to claim 1, wherein the receiving frame portion of the fitting portion has an inner wall formed with a guide portion that guides insertion of the connection object.

10. The connector according to claim 1, wherein the fitting portion is formed with a movement restricting portion that restricts movement of the second portion of the contact in an insertion direction of inserting the connection object jointly with part, facing the movement restricting portion in the insertion direction, of the attaching base portion.

11. The connector according to claim 1, wherein the attaching base portion is formed with a guide portion that guides the second portion of the contact when the contact is attached to and detached from the housing.

12. The connector according to claim 1, further comprising a signal contact.

13. A connector-attached housing structure comprising the connector according to claim 1 and a housing structure to which the connector is attached.

14. The connector-attached housing structure according to claim 13, wherein the connector comprises a plurality of connectors which are attached, in a lattice shape, to an attaching panel of the housing structure, and wherein the housing structure further comprises connecting members each connecting between the contacts of two of the connectors.

15. The housing structure according to claim 14, wherein the plurality of connectors attached to the attaching panel are connected in series by the connecting members.

16. The housing structure according to claim 13, wherein the connector further comprises a signal contact connected to an electric wire, and wherein the plurality of connectors are connected in series by the electric wires.

* * * * *